US006738056B2

(12) United States Patent
Waterman

(10) Patent No.: US 6,738,056 B2
(45) Date of Patent: May 18, 2004

(54) SYSTEM AND METHOD FOR HANDLING THE INPUT VIDEO STREAM FOR A DISPLAY

(75) Inventor: John Karl Waterman, Mesa, AZ (US)

(73) Assignee: Brillian Corporation, Tempe, AZ (US)

( * ) Notice: Subject to any disclaimer, the term of this patent is extended or adjusted under 35 U.S.C. 154(b) by 349 days.

(21) Appl. No.: 09/912,783

(22) Filed: Jul. 25, 2001

(65) Prior Publication Data

US 2003/0020683 A1 Jan. 30, 2003

(51) Int. Cl.[7] ..... G09G 5/00
(52) U.S. Cl. ..... 345/213; 348/500
(58) Field of Search ..... 345/213, 204; 348/500, 521, 537, 513

(56) References Cited

U.S. PATENT DOCUMENTS

| | | | | |
|---|---|---|---|---|
| 4,231,063 A | * | 10/1980 | Ito et al. | 348/513 |
| 4,985,770 A | | 1/1991 | Nagashima et al. | 358/152 |
| 5,179,692 A | | 1/1993 | Inoue | 395/500 |
| 5,488,393 A | * | 1/1996 | Wood et al. | 345/213 |
| 5,644,329 A | * | 7/1997 | Asari et al. | 345/89 |
| 5,973,758 A | | 10/1999 | Soroushian et al. | 348/845.2 |
| 6,023,262 A | | 2/2000 | Eglit | 345/131 |

FOREIGN PATENT DOCUMENTS

| | | | |
|---|---|---|---|
| DE | 19807257 A1 | 9/1999 | G09G/3/36 |
| EP | 0704833 A2 | 4/1996 | G09G/3/20 |
| EP | 0807923 A1 | 11/1997 | G09G/5/18 |
| EP | 0935386 A1 | 8/1999 | H04N/5/14 |

OTHER PUBLICATIONS

International PCT Search Report, PCT/US02/23258 with Notification of Transmittal of the International Search Report, 8 pp.

* cited by examiner

*Primary Examiner*—Richard Hjerpe
*Assistant Examiner*—Kevin Nguyen
(74) *Attorney, Agent, or Firm*—Baker Botts L.L.P.

(57) ABSTRACT

A system for handling an input video stream comprises an internal clock generator generating a first clock and a synchronization unit receiving the input video stream having an associated second clock being slower than the first clock. The synchronization unit samples the second clock with the first clock thereby generating a third clock synchronized with the first clock having no signal in case of a data gap. This signal can be used to determine the dwelling time for a charge being applied to a pixel which will be constant even without a buffer memory.

9 Claims, 5 Drawing Sheets

SYSTEM AND METHOD FOR HANDLING THE INPUT VIDEO STREAM FOR A DISPLAY

FIELD OF THE INVENTION

The present invention relates generally to display systems, and more particularly to a system and method for handling the input video stream for direct display on a liquid crystal display device (LCD).

BACKGROUND OF THE INVENTION

Liquid crystal displays (LCDs) are commonly used in devices such as portable televisions, portable computers, control displays, and cellular phones to display information to a user. LCDs act in effect as a light valve, i.e., they allow transmission of light in one state, block the transmission of light in a second state, and some include several intermediate stages for partial transmission. When used as a high resolution information display, as in one embodiment of the present application, LCDs are typically arranged in a matrix configuration with independently controlled pixels. Each individual pixel is signaled to selectively transmit or block light from a backlight (transmission mode), from a reflector (reflective mode), or from a combination of the two (transflective mode).

An LCD pixel can control the transference for different wavelengths of light. For example, an LCD can have pixels that control the amount of transmission of red, green, and blue light independently. In some LCDs, voltages are applied to different portions of a pixel to control light passing through several portions of dyed glass. In other LCDs, different colors are projected onto the pixel sequentially in time. If the voltage is also changed sequentially in time, different intensities of different colors of light result. By quickly changing the wavelength of light to which the pixel is exposed an observer will see the combination of colors rather than sequential discrete colors. Several monochrome LCDs can also result in a color display. For example, a monochrome red LCD can project its image onto a screen. If a monochrome green and monochrome blue LCD are projected in alignment with the red, the combination will be full color.

The monochrome resolution of an LCD can be defined by the number of different levels of light transmission that each pixel can perform in response to a control signal. A second level is different from a first level when the user can tell the difference between the two. An LCD with greater monochrome resolution will look clearer to the user.

LCDs are actuated pixel-by-pixel, either one at a time or several simultaneously. A voltage is applied to each pixel and the liquid crystal responds to the voltage by transmitting a corresponding amount of light. In some LCDs an increase in the actuation voltage decreases transmission, while in others it increases transmission. When multiple colors are involved for each pixel, multiple voltages are applied to the pixel at different positions or times depending upon the LCD. Each voltage controls the transmission of a particular color. For example, one pixel can be actuated to allow only blue light to be transmitted while another allows only green. A greater number of different light levels available for each color results in a much greater number of possible color combination.

Converting a complex digital signal that represents an image or video into voltages to be applied to the pixels of an LCD involves circuitry that can limit the monochrome resolution. The signals necessary to drive a single color of an LCD are both digital and analog. It is digital in that each pixel requires a separate selection signal, but it is analog in that an actual voltage is applied to the pixel to determine light transmission. A input video stream, such as a TV, video camera signal, etc., is usually generated by an external unit and comprises video data as well as a video clock. The video clock represent, for example, the timing of the respective pixel data in a input video stream. The conversion of an external input video stream into a internal video signal, which can control a display, such as an LCD, can introduce errors that reduce the monochrome resolution of the LCD or result in specific artifacts, such as shades, lines, etc. Therefore, display systems usually provide a buffer memory, also known as a video memory, which is read with an internal clock to generate the respective driver signals at a constant rate. The video buffer is written asynchronously, for example according to the external video clock.

SUMMARY OF THE INVENTION

The embodiments of the present application are directed to a system and method for providing system and method of handling a input video stream without the need of a buffer memory. Furthermore, it is desired to run a display driver based on a clock which is generated internally because such a clock is more reliable.

With improvements in technology it is possible in some applications to deliver video data fast enough to directly pass them into a display, such as a LCD or any other type of display. This mode according to the present application is called unbuffered operation. The advantage of such a system is obvious as it does not need a buffered memory and therefore can be manufactured at a lower price. In this mode the video data is accepted on the external video clock which is called the dot clock. This external dot clock is presented synchronously with their video data. The embodiments according to the present application accept that pixel as it is supplied and change their time domain from the external time domain to an internal time domain. This is necessary as the internal time domain is more reliable and needed to run certain circuitry within the chip. To avoid any data loss the internal data clock has to be higher in frequency than the external data clock. Normally, every once in a while this will cause a system clock pulse where there would be no data. This is called a gap in data. In prior art embodiments a buffer memory is used, so no effect on the handling of the data takes place. This is because everything is done in a step-by-step mode as the buffer is written and read with different signals causing a constant read out of the memory. However, with unbuffered data coming through a data gap will cause that the data preceding the data gap will dwell twice as long on a display pixel as normal for each pixel.

The present application avoids this by disconnecting the digital-to-analog converter from the column and not reconnecting it until after the next data has been received. Thus, a constant dwell time for each pixel is maintained.

A first embodiment for handling an input video stream comprises an internal clock generator generating a first clock and a synchronization unit receiving the input video stream having an associated second clock being slower than the first clock, whereby the synchronization unit samples the second clock with the first clock thereby generating a third clock synchronized with the first clock having no signal in case of a data gap. This signal can be used to determine the dwelling time for a charge being applied to a pixel which will be constant even without a buffer memory.

An enhanced embodiment further comprises a digital-to-analog-converter receiving video data from the video stream being controlled by the third clock.

Yet another enhanced embodiment further provides a digital-to-analog-converter receiving video data from the video stream generating an analog output signal and a sample-and-hold-unit receiving the analog output signal and being controlled by the third clock.

In yet another enhanced embodiment the synchronization unit further generates a fourth signal derived from the third signal which is time delayed for determination of pixel dwelling time.

In yet another embodiment the synchronization unit comprises a first flip-flop having a set and a reset input and an output, whereby the set input receives the second clock and the reset input receives the first clock. A first AND gate having two inputs and an output is provided, whereby the first input is coupled with the output of the first flip-flop and the second input receives the first clock. Furthermore, a second flip-flop having a set and a reset input and an output is provided, whereby the set input is coupled with the output of the AND gate and the reset input receives the first clock. Finally, a second AND gate having two inputs and an output is provided, whereby the first input is coupled with the output of the second flip-flop and the second input receives the inverted first clock.

An embodiment of a display system comprises a liquid crystal display having a plurality of pixels organized in columns and rows and a display control unit comprising a unit for handling an input video stream. The display system further comprises an internal clock generator generating a first clock and a synchronization unit receiving the input video stream having an associated second clock being slower than the first clock, whereby the synchronization unit samples the second clock with the first clock thereby generating a third clock synchronized with the first clock having no signal in case of a data gap, wherein the third clock controls the charging of a pixel.

A further enhancement of this display system comprises a digital-to-analog-converter receiving video data from the video stream being controlled by the third clock.

Another enhancement of this display system comprises a digital-to-analog-converter receiving video data from the video stream and generating an analog output signal, wherein the liquid crystal display further comprises column metallizations and whereby the output signal charges a respective column metallization and the control signal controls the time the charge on the column metallization is put on a respective pixel of the liquid crystal display.

Yet another enhancement of the display system further provides a digital-to-analog-converter receiving video data from the video stream generating an analog output signal and a sample-and-hold-unit receiving the analog output signal and being controlled by the third clock.

In yet another enhanced embodiment the synchronization unit of the display system further generates a fourth signal derived from the third signal which is time delayed for determination of pixel dwelling time.

In yet another enhancement display system the synchronization unit comprises a first flip-flop having a set and a reset input and an output, whereby the set input receives the second clock and the reset input receives the first clock; a first AND gate having two inputs and an output, whereby the first input is coupled with the output of the first flip-flop and the second input receives the first clock; a second flip-flop having a set and a reset input and an output, whereby the set input is coupled with the output of the AND gate and the reset input receives the first clock; and a second AND gate having two inputs and an output, whereby the first input is coupled with the output of the second flip-flop and the second input receives the inverted first clock.

A method for handling an input video stream comprises the steps of generating a first clock; receiving the input video stream having an associated second clock being slower than the first clock; and sampling the second clock with the first clock thereby generating a third clock synchronized with the first clock having no signal in case of a data gap.

An enhancement of this method further comprising the step of converting the video data from the video stream into an analog signal and clocking the analog signal by the third clock.

A method for driving a liquid crystal display having a plurality of pixels organized in columns and rows, comprises the steps of generating a first clock; synchronizing the input video stream having an associated second clock being slower than the first clock by sampling the input video stream with the first clock thereby generating a third clock synchronized with the first clock having no signal in case of a data gap and controlling the charge of a pixel by the third clock.

An enhancement of this method further comprises the steps of converting the video data from the video stream into an analog signal and applying the analog signal to a pixel for a time period controlled by the third clock.

In yet another enhancement of this method the display further comprises column metallizations and the method further comprises the steps of converting the video data from the video stream into an analog signal, applying the analog signal to the column metallization to charge the column metallization and transferring the charge to a pixel for a time period controlled by the third clock.

BRIEF DESCRIPTION OF THE DRAWINGS

A more complete understanding of the present disclosure and advantages thereof may be acquired by referring to the following description taken in conjunction with the accompanying drawings, in which like reference numbers indicate like features, and wherein.

DETAILED DESCRIPTION OF THE PREFERRED EMBODIMENTS

Figure 1:
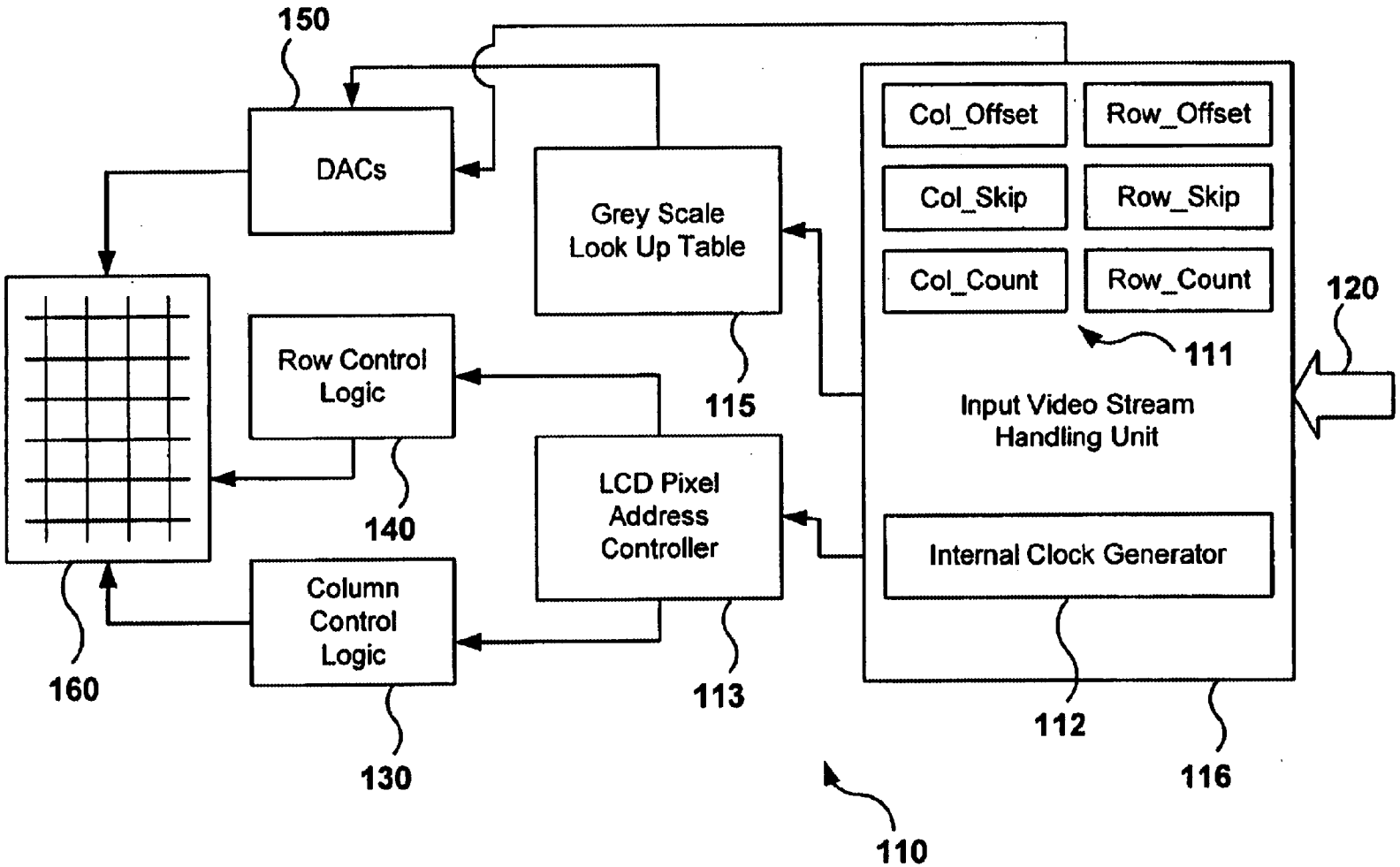
FIG. 1 is a block diagram of a liquid crystal display driver circuitry in accordance with one embodiment of the present application.

Turning to the drawings, exemplary embodiments of the present application will now be described. FIG. 1 depicts a high-level block diagram of a LCD driver system represented by the numeral 110 for actuating pixels of a liquid crystal display screen 160 in accordance with video data. A liquid crystal display 160 is usually arranged in a matrix of rows and columns as indicated in FIG. 1. A video software program may access stored data representing an image or series of images and generate a video stream. The video software program locates pixel-specific information in the stored data according to its protocol. For example, the data may be stored in Apple Corporation's Quicktime format, Microsoft Corporation's Media Player format, MPEG-2 standard format, and the like. The video software outputs a input video stream 120, for example, for 256 gray shades.

The signal 120 can also provide color information instead of gray shade information. In another embodiment, the software program receives video data directly from an optical recording device such as a video camera, a DVD player, a Personal Computer, a TV tuner, etc.

One or more DACs 150 are adapted to receive digital amplitude information from a gray scale look up table 115. In another embodiment color data is fed to a plurality of DACs 150. The gray scale look up table 115 receives pixel grayscale information from the input video stream handling unit 116 which is adapted to convert video information 120 into corresponding pixel information (grayscale and pixel address information) and synchronize it with an internal clock generated by the internal clock generator 112. The input video stream handling unit can have a plurality of control registers 111. Thus, the system is programmable in its control fictions. For example, a column offset and a row offset register for controlling a column offset can be provided. Furthermore, registers for controlling a column and/or row skip function can be included in the input video stream handling unit. Those registers can control where and how much of an image is to be displayed on the display 160. Registers for determining an actual offset on the display are depicted in FIG. 1 as registers COL_OFFSET and ROW_OFFSET. The skip registers COL_SKIP, ROW_SKIP determine a predefined amount of columns and rows to be skipped. The count registers COL_COUNT and ROW_COUNT define the column and row number that have to be reached for the defined display. A plurality of other registers can be included in the input video stream handling unit as well as in other control units of the display system 110.

Pixel address information is sent to an LCD pixel address controller 113 which is adapted to control the row control logic 140 and column control logic 130. The gray scale look up table 115 determines the necessary gray scale value. Input video stream handling unit 116 furthermore provides additional control signals to control the DACs 150.

The video information 120 is received by LCD driver system 110. The driver system 110 converts the video information 120 from an analog or digital format to pixel-specific gray-scale voltages. In one embodiment, a single voltage source for each pixel drives a monochrome display. In another embodiment, a pixel has several voltages each for a different color, sequentially applied, in order to drive a fall color display. A driver system 110 can be provided for each color (red, green, blue) for which there is video information 120. The driver electronics then provides those pixel charging voltages and control signals to the liquid crystal display 160. Each pixel-charging voltage corresponds to one pixel of one image.

The liquid crystal display 160 receives voltages to individual pixels and, in some embodiments, for particular colors for each pixel. The liquid crystal display 160 is adapted to select pixels of which voltages are applied in accordance with received control signals. The voltages change the light transfer characteristics of the pixels. The collective visual impact of the selectively lighted pixels portrays an image.

Figure 2:
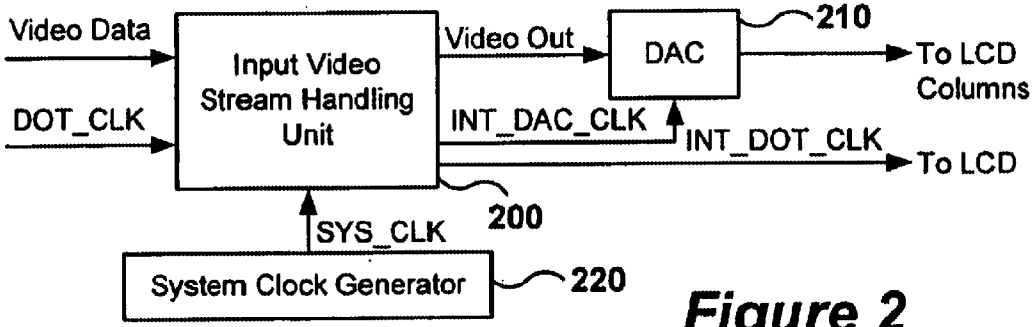
FIG. 2 is a block diagram of a synchronization unit in accordance with one embodiment of the present application.
Figure 3:
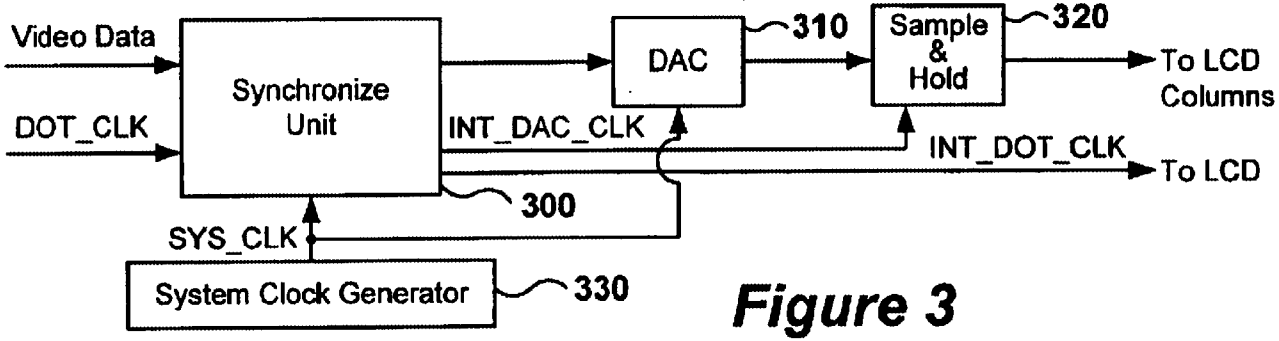
FIG. 3 is a block diagram of a synchronization unit in accordance with another embodiment of the present application.
Figure 4:
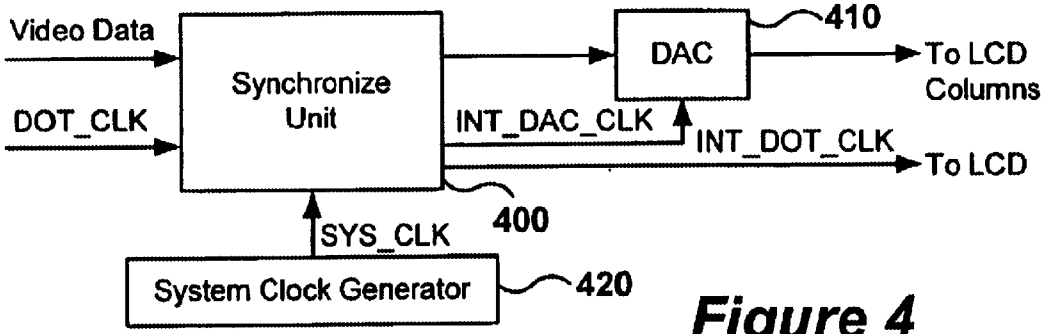
FIG. 4 is a block diagram of a clock synchronization according to the, present application.

The driver system 110 can be integrated into an ASIC design. The handling of the input video stream is of particular interest according to this application. As mentioned above, it is always desired to use an internal clock rather than a supplied user clock. This allows the respective chip to run reliably without depending on the user supplied clock. One of the key concepts of using a ASIC is therefore the use of this internally generated system clock for most of the chip's function instead of using the user supplied dot clock. This way, the display can be driven black and registers as described above can be read, written and implemented, all without needing an input video bus. To this end, a resynchronizer circuit as, for example, shown in FIGS. 2 to 4 is used to transfer the incoming pixel data from the dot clock domain into the system clock domain.

However, in making the transfer from the dot clock to the system clock, the pixel rate of the system clock must always be slightly faster than the incoming pixel rate. Otherwise, one risks losing pixel information. There will be gaps in the data stream depending on the ratio between the external dot clock and the internal system clock when no valid data is available for a particular system clock cycle. The greater the disparity between the faster system clock and the slower external dot clock, the more gaps will be created in the data.

When working in the mode that uses a frame-buffer, the data gaps cause pauses when writing data, at system clock, into the frame buffers. However, the read-outs to the display occur at system clock with no data gaps as this process is completely independent from the incoming video data and its associated dot clock. The problem solved by the present application is therefore related to solutions working without a frame buffer or to solutions having the ability to select using a frame buffer or not. If nothing was done, some of the data just before a data gap would dwell on its respective display pixel twice as long as normally. This could raise unwanted artifacts because some pixel would have twice the slew and settle time as other pixels. The solution according to the present application and the respective embodiments is to stagger the digital-to-analog-converter clock from the column clock or the clock controlling the digital-to-analog-converter when a data gap occurs. According to this solution all display pixels driven by the system will have the same dwell time. Thus, artifacts will be avoided by this solution and a stable operation using an internal system clock will be provided.

Digital or analog video data usually consists of a dot clock and respective video signals. The dot clock indicating the timing for each pixel can also be combined within one of the video signals. For a better understanding FIGS. 2–4 depict the input video stream separated into a clock signal and a video data signal which might consist of a plurality of data and control signals. For the handling of the incoming video stream the external dot clock is the signal the system has to be synchronized with. Turning now to FIG. 1, this incoming video stream VIDEO_DATA and DOT_CLK is fed to a input video stream handling unit 200. The input video handling unit is supplied with an internal system clock by system clock generator 220. Input video stream handling unit generates an internal VIDEO_OUT, internal gated display latch clock INT_DOT_CLK, and dot clock INT_DAC_CLK which control a digital-to-analog-converter DAC 210. The analog output signal is then fed to the LCD proper, for example the LCD columns. A differently gated display latch clock INT_DOT_CLK is brought out to the LCD proper in order to accomplish the purposes of this invention as will be shown below. This signal is time delayed in comparison with the dot clock signal INT_DAC_CLK. Thus, it can be used to determine the actual dwelling time of each voltage applied to a pixel.

Input video stream handling unit comprises the resynchronization circuits which synchronize the external video data with the internal clock generated by system clock generator 220. To this end, the video data signal is sampled and output to the digital-to-analog-converter 210. The internal system clock is used to sample the external video data stream. Therefore, the internal system clock frequency has to be higher than the dot clock frequency. Preferably, the system clock is about 1.05 times to 2.0 times the expected dot clock and is created by a phase-locked-loop unit (PLL). The internally generated dot clock which controls the digital-to-analog-converter 210 determines the dwell time the for the generated analog output signal of digital-to analog-converter 210. Input video stream handling unit 200 comprises the necessary circuitry to guarantee a constant dwell time for each pixel to be displayed on the LCD, for example, 25 nanoseconds. This circuitry will be explained in more detail in the following description.

FIG. 3 shows a first embodiment of a synchronization circuitry within the input video stream handling unit 200 in form of a block diagram. A synchronize unit 300 receives the input video stream comprising a video data signal VIDEO_DATA signal and a dot clock DOT_CLK. Data to be converted by respective digital-to-analog-converters (only one shown) is fed to a DAC 310. A system clock generator 330 generates the internal system clock which is fed to synchronize unit 300 and DAC 310. The synchronize unit 300 generates a gated display latch clock INT_DOT_CLK which is sent to the LCD proper and an internal dot clock INT_DAC_CLK which controls a sample-and-hold unit 320. Sample-and-hold unit 320 receives an analog signal from the output of DAC 310 and generates an output signal which is fed to the LCD columns.

In this embodiment synchronize unit 300 samples and synchronizes the incoming video data stream with the internal system clock. The valid digital data to be converted is fed directly to a DAC 310. Thus in case of a data gap, a data word submitted to the DAC 310 is output by the DAC 310 until the next data word is available. Therefore, the output time period for pixel data which precedes a data gap is twice as long as for pixel data which lie within a data sequence with no gaps. The internal dot clock INT_DAC_CLK takes this under consideration. Whenever a data gap occurs, a pulse of the dot clock associated with the gap is skipped. Thus, during a data gap, internal system clock SYS_CLK and dot clock INT_DAC_CLK are present but gated display latch clock INT_DOT_CLK is not. At the clock ahead of the data gap, dot clock INT_DAC_CLK is not present, but gated display latch clock INT_DOT_CLK is present as will be shown later in more detail. This internal dot clock INT_DAC_CLK controls a sample-and-hold unit 320. Therefore, the output of sample-and-hold unit 320 is synchronized with this signal and the time period for each analog pixel data has a constant time period.

FIG. 4 depicts another embodiment of a synchronization circuitry within the input video stream handling unit 200 of FIG. 2 in form of a block diagram. A synchronize unit 400 receives the input video stream comprising a video data signal VIDEO_DATA signal and a dot clock DOT_CLK. Data to be converted by respective digital-to-analog-converters (only one shown) is fed to a DAC 410. A system clock generator 420 generates the internal system clock which is fed to synchronize unit 300. The synchronize unit 300 generates an internal dot clock INT_DOT_CLK which controls DAC 410 and a gated display latch clock INT_DOT_CLK which is fed to the LCD proper. DAC 410 generates an output signal which is fed to the LCD columns.

This embodiment is operating generally in the same way as the embodiment shown in FIG. 3. The difference is that the no sample-and-hold unit 320 is used. Instead, DAC 410 is controlled directly by the internal dot clock INT_DAC_CLK generated by synchronize unit 400.

Figure 6:
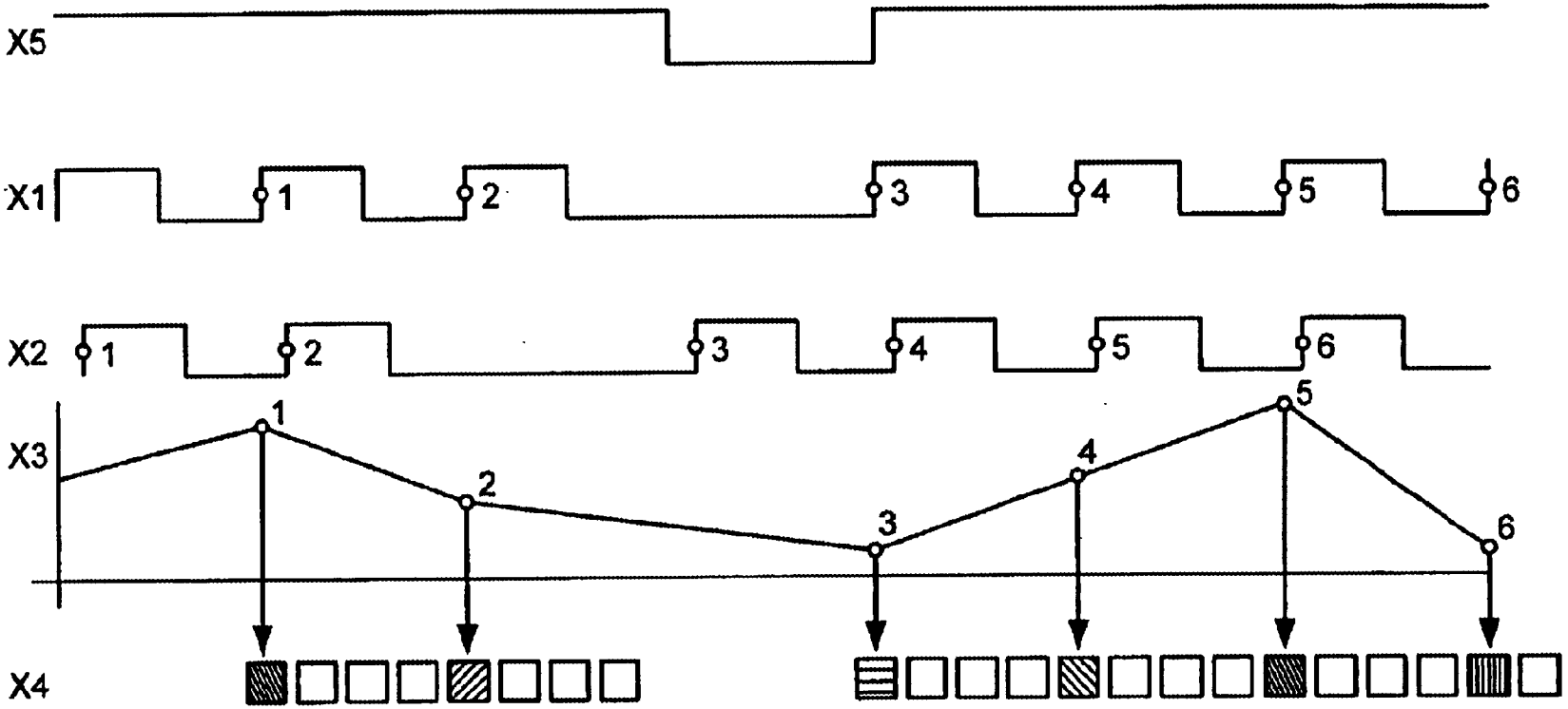
FIG. 6 is timing diagram showing different signals according to the present application.

FIG. 6 is a timing diagram showing the relationship between the different signals according to the present application. XI denotes the gated display latch clock INT_DOT_CLK which controls signals fed to columns of a LCD and X2 denotes the internal dot clock INT_DAC_CLK. X3 depicts an exemplary analog output signal of a digital-to-analog converter controlled by signal X3 and X4 shows the effect on respective pixels of a LCD according to the present application. It can be seen that X3 shows the voltage going asymptotically to the desired analog voltage. X4 is in particular shown for a 4-channel microdisplay, thus, for example, X1 latches the analog voltage into every fourth pixel in a microdisplay row. Different gray-shades are shown as different patterns. X5 shows in addition a data valid signal (not shown in the figures) coming out of the input video stream handling unit which is synchronized with gated display latch clock INT_DOT_CLK (X1). FIG. 6 shows signals of yet another embodiment showing in particular the timing between the signals actually controlling the respective columns of a LCD. This embodiment combines the features of the embodiments depicted in FIGS. 3 and 4. Numerals within FIG. 6 denote different pixel data within a pixel sequence. X3 shows the charging of a column metallization within a cycle of the internal dot clock X3 applied to the DAC. Usually a liquid crystal display, in particular a microdisplay, comprises long column metallizations running from the display and when an analog voltage is charged to a pixel, in effect the column metal is charged, namely the whole length of it. The particular row which is addressed in form of a row signal puts the charge of voltages on the column metal for a specific pixel. In other words, the column metal is rather charged than the actual pixel and with the appropriate row signal the charge is transferred from the column metal to the respective pixel. The pixel capacitance, in particular of a microdisplay pixel, is much smaller than the column capacitance. Therefore, the column voltage will not be affected by the transfer. Column control signal X1 actually sets the time period the respective analog signal X3 is fed to the respective columns. The result can be seen as X4 in the row below. For this example, a normally white microdisplay is shown. The higher the voltage of the video signal the blacker the pixel will appear. This is indicated by different patterns in FIG. 6. As can be readily seen, all pixels will have the same dwell time. During the data gap, the voltage applied to the columns of the LCD is never latched in. Of course, other means can be provided to prevent latching of a voltage during a data gap. The main characteristic of the present invention is to treat every pixel the same and not to allow some pixels to have twice the asymptotic settling time during periods of a data gap.

Figure 5:
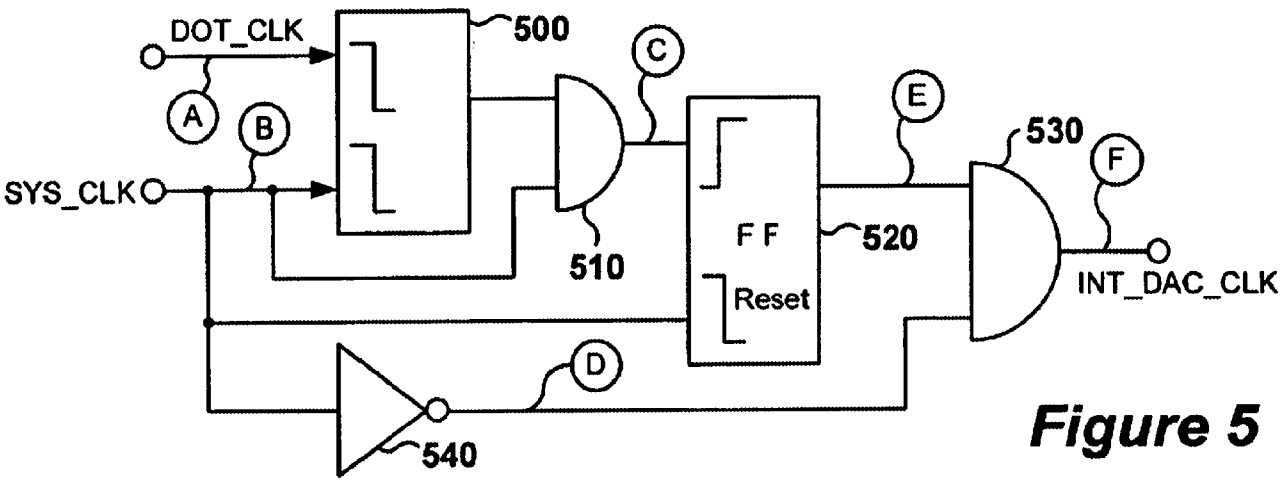
FIG. 5 is a circuit diagram a clock synchronization unit according to FIG. 5.

FIG. 5 shows an embodiment of the synchronization units 300 and 400 depicted in FIGS. 3 and 4. The dot clock DOT_CLK is fed to a first input of a first flip-flop 500. The system clock SYS_CLK is fed to the second input of flip-flop 500 and to the first input of an AND gate 510. The output of flip-flop 500 is coupled with the second input of AND gate 510 whose output is connected with the first input of a second flip-flop 520. The second input of second flip-flop 520 receives the system clock SYS_CLK. The output of flip-flop 520 is coupled with the first input of another AND gate 530. A inverter 540 is provided which receives the system clock SYS_CLK and feeds the inverted system clock SYS_CLK to the second input of AND gate 530. The output of AND gate 530 carries the synchronized dot clock INT_DAC_CLK.

The inputs of flip-flop 500 are sensitive to the falling edge of each respective input signal DOT_CLK and SYS_CLK. Signal DOT_CLK fed to the first input of flip-flop 500 sets it and the second signal SYS_CLK fed to the second input resets the flip-flop 500. Flip-flop 520 comprises a set input sensitive to the rising edge and a reset input which is sensitive to the falling edge of the respective input signal.

Figure 7:
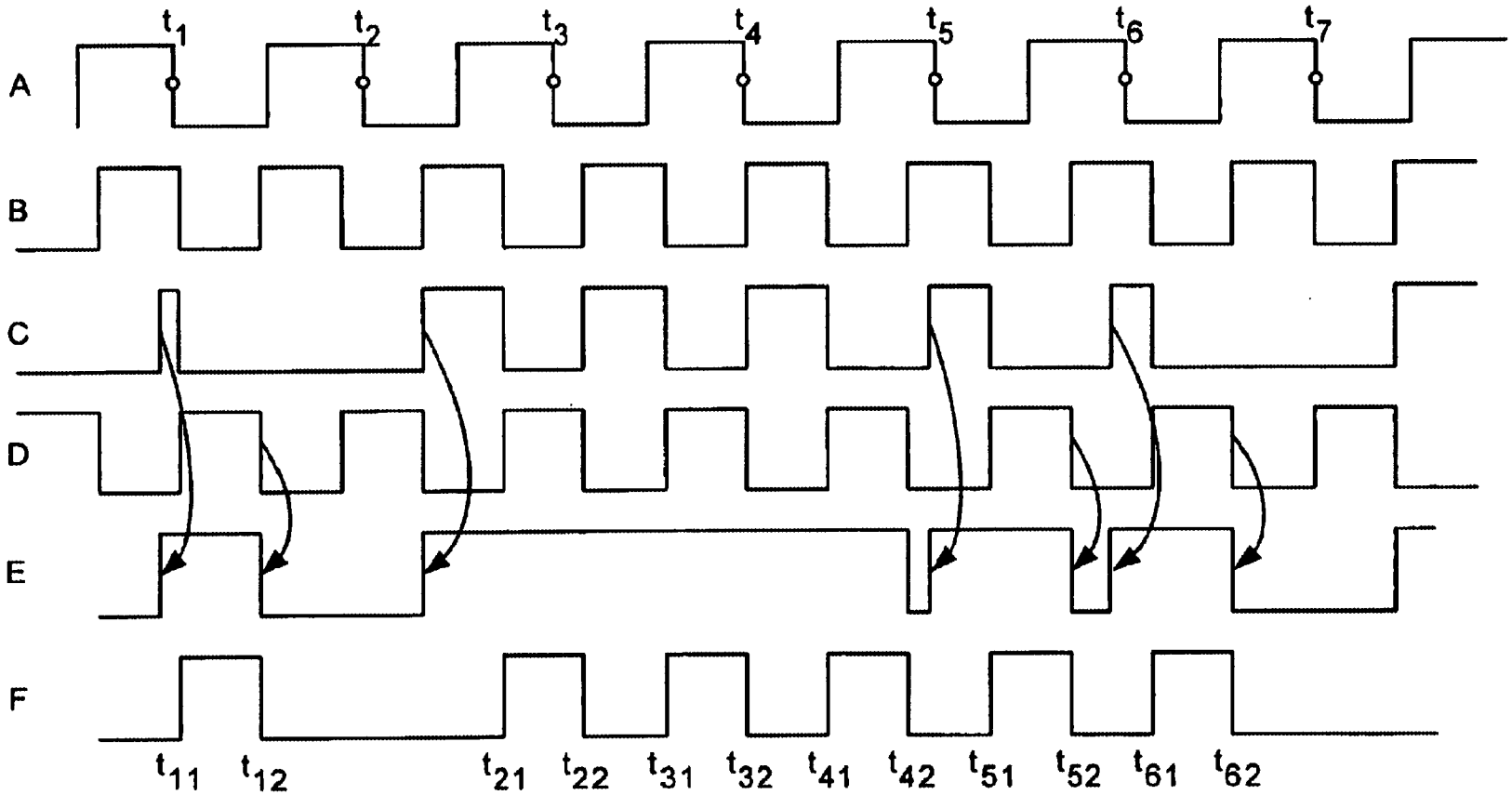
FIG. 7 is another timing diagram showing different signals of a clock synchronization unit according to FIG. 5.

FIG. 7 shows the timing of different signals denoted in FIG. 5. A represents the external dot clock DOT_CLK and B the internal system clock SYS_CLK. C denotes the output signal of AND gate 510 and E the output signal of flip-flop 520. The inverted internal system clock is represented by reference symbol D and the internal synchronized dot clock INT_DAC_CLK is denoted by F.

At time $t_1$ with the falling edge of signal A flip-flop 500 is set. Shortly after this time, the falling edge of signal B resets flip-flop 500. The output of this signal is ANDed by AND gate 510 and results in a short pulse of signal C. The rising edge of signal C at time $t_1$ sets flip-flop 520 as can be seen in signal E. Flip-flop 520 is reset by the falling edge of signal D. AND gate 530 synchronizes signal E with signal D. As the frequency of B is higher than the frequency of A, no data signal is available with the second pulse of B shown in FIG. 7. In this case no output signal of AND gate 510 is created. This results in a pulse gap of signal F. Thus, for the time period of the data gap no signal will be fed to the columns of the LCD.

The arrangement according to FIG. 5 is designed in a way that the timing according to FIG. 7 is provided. Thus, transit time of the respective signals is accordingly adapted. For example, the falling edge of signal A at time $t_2$ generates in combination with signal B the next rising edge of signal C. As signals C and D are synchronized the falling edge of D and the rising edge of C take place at the same time $t_{22}$ and $t_{32}$ in this example. Therefore, the gates have to be designed in a way to guarantee that signal E stays at a logic "1" in this event as shown in FIG. 7. For example, the gates are designed to produce specific transit time so that a little gap between the falling edge of signal D and the rising edge of signal C is created. The resulting signal E at times $t_{22}$ and $t_{32}$ is shown in FIG. 7.

At time $t_5$, signal C is not synchronous with signal D with regard to their rising and falling edges, respectively. The pulse width of signal C gets again smaller until after time $t_6$ where another data gap occurs which generates another pulse gap in signal F as explained above.

While the present embodiments are susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims. For example, the embodiments shown and explained can drive other types of displays which show similar unwanted charcteristics when the dwelling time of a pixel signal is changing.

What is claimed is:

1. A system for handling an input video stream comprising:

an internal clock generator generating a first clock;

a synchronization unit receiving said input video stream having an associated second clock being slower than said first clock, whereby said synchronization unit samples said second clock with said first clock thereby generating a third clock synchronized with said first clock having no signal in case of a data gap;

wherein said synchronization unit comprises:

a first flip-flop having a set and a reset input and an output, whereby said set input receives said second clock and said reset input receives said first clock;

a first AND gate having two inputs and an output, whereby said first input is coupled with said output of said first flip-flop and said second input receives said first clock;

a second flip-flop having a set and a reset input and an output, whereby said set input is coupled with the output of said AND gate and said reset input receives said first clock; and a second AND gate having two inputs and an output, whereby said first input is coupled with said output of said second flip-flop and said second input receives the inverted first clock.

2. The system according to claim 1, further comprising a digital-to-analog-converter receiving video data from said video stream being controlled by said third clock.

3. The system according to claim 1, further providing:

a digital-to-analog-converter receiving video data from said video stream generating an analog output signal;

a sample-and-hold-unit receiving said analog output signal and being controlled by said third clock.

4. The system according to claim 1, wherein said synchronization unit further generates a fourth signal derived from said third signal which is time delayed for determination of pixel dwelling time.

5. A display system comprising:

comprising a liquid crystal display having a plurality of pixels organized in columns and rows;

a display control unit comprising a unit for handling an input video stream which comprises:

an internal clock generator generating a first clock;

a synchronization unit receiving said input video stream having an associated second clock being slower than said first clock, whereby said synchronization unit samples said second clock with said first clock thereby generating a third clock synchronized with said first clock having no signal in case of a data gap, wherein said third clock controls the charging of a pixel;

wherein said synchronization unit comprises:

a first flip-flop having a set and a reset input and an output, whereby said set input receives said second clock and said reset input receives said first clock;

a first AND gate having two inputs and an output, whereby said first input is coupled with said output of said first flip-flop and said second input receives said first clock;

a second flip-flop having a set and a reset input and an output, whereby said set input is coupled with the output of said AND gate and said reset input receives said first clock; and a second AND gate having two inputs and an output, whereby said first input is coupled with said output of said second flip-flop and said second input receives the inverted first clock.

6. The display system according to claim 5, further comprising a digital-to-analog-converter receiving video data from said video stream being controlled by said third clock.

7. The display system according to claim 5, further comprising a digital-to-analog-converter receiving video data from said video stream and generating an analog output signal and wherein said liquid crystal display further comprises column metallizations, whereby said output signal charges a respective column metallization and said control signal controls the time the charge on said column metallization is put on a respective pixel of said liquid crystal display.

8. The display system according to claim 5, further providing:

a digital-to-analog-converter receiving video data from said video stream generating an analog output signal;

a sample-and-hold-unit receiving said analog output signal and being controlled by said third clock.

9. The display system according to claim 5, wherein said synchronization unit further generates a fourth signal derived from said third signal which is time delayed for determination of pixel dwelling time.

* * * * *